US010563864B1

(12) United States Patent
Guinn

(10) Patent No.: US 10,563,864 B1
(45) Date of Patent: Feb. 18, 2020

(54) STRIKER FOR GAS-BURNING TOOL

(71) Applicant: Cody Guinn, Cleveland, OK (US)

(72) Inventor: Cody Guinn, Cleveland, OK (US)

( * ) Notice: Subject to any disclaimer, the term of this patent is extended or adjusted under 35 U.S.C. 154(b) by 0 days.

(21) Appl. No.: 16/547,680

(22) Filed: Aug. 22, 2019

(51) Int. Cl.
*F23Q 2/16* (2006.01)
*F23Q 2/46* (2006.01)

(52) U.S. Cl.
CPC ..... *F23Q 2/161* (2013.01); *F23Q 2/46* (2013.01)

(58) Field of Classification Search
CPC ... F23Q 2/08; F23Q 2/16; F23Q 2/164; F23Q 2/48; F23Q 2/14; F23Q 1/02; F23Q 1/00; F23Q 1/06; F23Q 3/002; F23Q 2/46; F23Q 2/161; F23D 14/38; F23D 2207/00; F23D 14/465
USPC ..... 431/273–274
See application file for complete search history.

(56) References Cited

U.S. PATENT DOCUMENTS 1,391,582 A * 9/1921 Rollerson ..... F23Q 2/14 431/143
2,826,904 A * 3/1958 Williamson ..... F23Q 2/48 431/276
2,986,208 A * 5/1961 Aciego ..... F23Q 2/48 431/276
3,052,112 A * 9/1962 Wheeler ..... B23K 5/22 431/276
3,154,936 A * 11/1964 Primich ..... F23Q 1/02 431/276
3,275,060 A * 9/1966 Lindgren ..... F23D 14/38 431/276
4,181,492 A * 1/1980 Zinke ..... F23Q 3/002 310/339
4,231,734 A * 11/1980 Burns ..... F23Q 1/02 431/274
4,459,096 A * 7/1984 Fischer ..... F23Q 1/06 431/273
2017/0089576 A1* 3/2017 Morehead ..... F23Q 1/02

* cited by examiner

*Primary Examiner* — Jorge A Pereiro
(74) *Attorney, Agent, or Firm* — William Lovin & Assoc., LLC; William R. Lovin

(57) ABSTRACT

This invention relates to a striker for gas-burning tools. More specifically, a tool that may be affixed to the gas discharge end of a gas-burning tool that offers a manual striker mechanism that may be used to ignite the gas-burning tool. The manual striker mechanism includes a friction based sparking device.

8 Claims, 3 Drawing Sheets

STRIKER FOR GAS-BURNING TOOL

CROSS-REFERENCE TO RELATED APPLICATIONS

Not applicable.

FIELD OF THE INVENTION

This invention relates to a striker for gas-burning tools. More specifically, a tool that may be affixed to the gas discharge end of a gas-burning tool that offers a manual striker mechanism that may be used to ignite the gas-burning tool. The manual striker mechanism includes a friction based sparking device.

BACKGROUND OF THE INVENTION

The need to start gas-burning tools has been addressed by a variety of striking mechanisms including a hand-held friction striking mechanism, torches, and matches.

What is needed therefore is a friction based striking mechanism that may be affixed to the gas discharge end of a gas-burning tool.

What is also needed is a friction based striking mechanism that is compact and does not interfere with the use of the gas-burning tool.

What is also needed is a friction based striking mechanism that may be used and then stowed away outside of the path of the burning gas.

What is also needed is a friction based striking mechanism that may be used and then reused multiple times.

SUMMARY OF THE INVENTION

The preferred embodiment of the present invention is a spark generating device comprising an affixing member hingedly attached to a guide member comprising a flint activated by a rotary striking element. The rotary striking element is driven by a formed planar spring. The spark generating device is affixed to the gas-burning tool using the affixing member to affix the device to the gas discharge end of the gas-burning tool.

The affixing member is a generally circular band of a greater diameter that the end of the gas-burning tool around which it is attached. Those having skill in the art will recognize that the affixing member may be other geometries than circular and may be any shape necessary to affix the device to the discharge end of the gas-burning tool.

The affixing member has at least two radially penetrating screws which have knurled screw tops designed to be screwed in and out by hand. When screwed in, the radially penetrating screws attach the affixing member to the outside of the discharge end of the gas-burning tool. On top of the affixing member is a radially projecting mounting tab with a locking slot cut into its rear tip.

Hingedly affixed to the affixing member is the guide member. The guide member is formed of two parallel, coequally sized pieces hinged to the affixing member and may be rotated in excess of 180° generally to the rear or generally to the front. Those having skill in the art will recognize that the guide member may be formed in many ways, including being constructed of one piece of material bent or stamped to form two parallel, coequally sized pieces which may be hinged to the affixing member and may be rotated in excess of 180° generally to the rear or generally to the front. When rotated to the rear a locking strap with a locking tab engages with the radially cut locking slot in the affixing member to secure the guide member to the rear. Ordinarily, this is the position of the guide member when the gas-burning tool is being used.

Secured between the parallel, coequally sized pieces is a formed planar spring. The formed planar spring is secured in a fixed position between the parallel, coequally sized pieces such that its free end is positioned next to a sparking wheel with tangs formed in its outer, circular surface. The formed planar spring is constructed such that a bent section extends outside the confines of the parallel, coequally sized pieces.

The sparking wheel is comprised of three layers. Two outer layers have generally triangular tangs contacting the formed planar spring. The side of each generally triangular tang contacting the formed planar spring projects radially from the circular edge of the sparking wheel. The edge of each tang facing away from the formed planar spring is non-radially arranged. The central layer has an abrasive layer of emery or corundite layer. The abrasive layer of emery or corundite layer may be adhesively applied or mechanically formed. The abrasive layer of emery or corundite layer contacts a ferrocerium element. The ferrocerium element is mounted in the tip of an adjusting screw.

The adjusting screw is mounted at the end of the parallel, coequally sized pieces in a mounting element adjoining the free ends of the parallel, coequally sized pieces. The adjusting screw is configured such that as the adjusting screw is screwed in, the ferrocerium element is brought nearer the abrasive layer of emery or corundite on the sparking wheel.

The spark generating device is used in the following manner: 1) The spark generating device is affixed to the torch near the gas discharge end of the gas-burning tool; 2) The radially penetrating screws are adjusted to clamp the spark generating device onto the gas-burning tool; 3) The guide member is rotated backwards so that the adjusting screw faces away from the exit port of the gas-burning tool and the locking tab engages with the radially cut locking slot in the affixing member; 4) The guide member is rotated all the way forward until the bent section of the formed planar spring contacts the barrel of the gas-burning tool; 5) This causes the sparking wheel to rotate; 6) This causes the abrasive layer of emery or corundite to rub against the ferrocerium element; 7) This cause sparks to be showered into the gas discharge of the gas-burning tool; 8) This causes a flame to ignite; and, 9) After the flame has ignited, the guide member is then rotated backwards so that the adjusting screw faces away from the exit port of the gas-burning tool and the locking tab engages with the radially cut locking slot in the affixing member.

DETAILED DESCRIPTION

Figure 1:
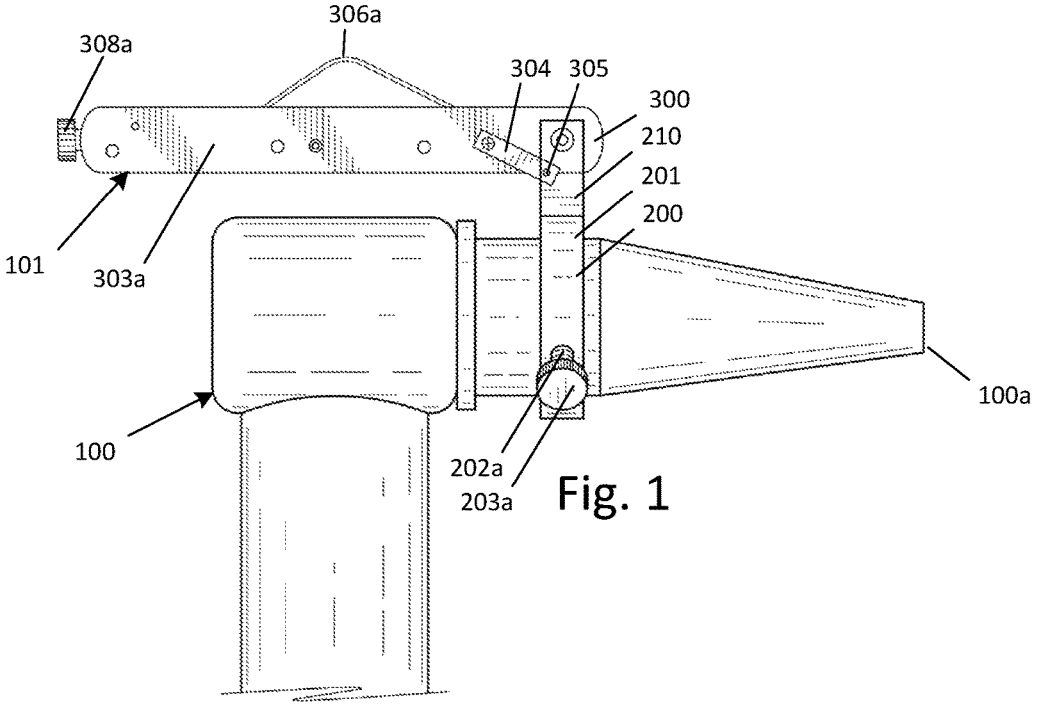
FIG. 1 is a side view of a gas-burning device with the invention affixed and stowed in the undeployed state.
Figure 2:
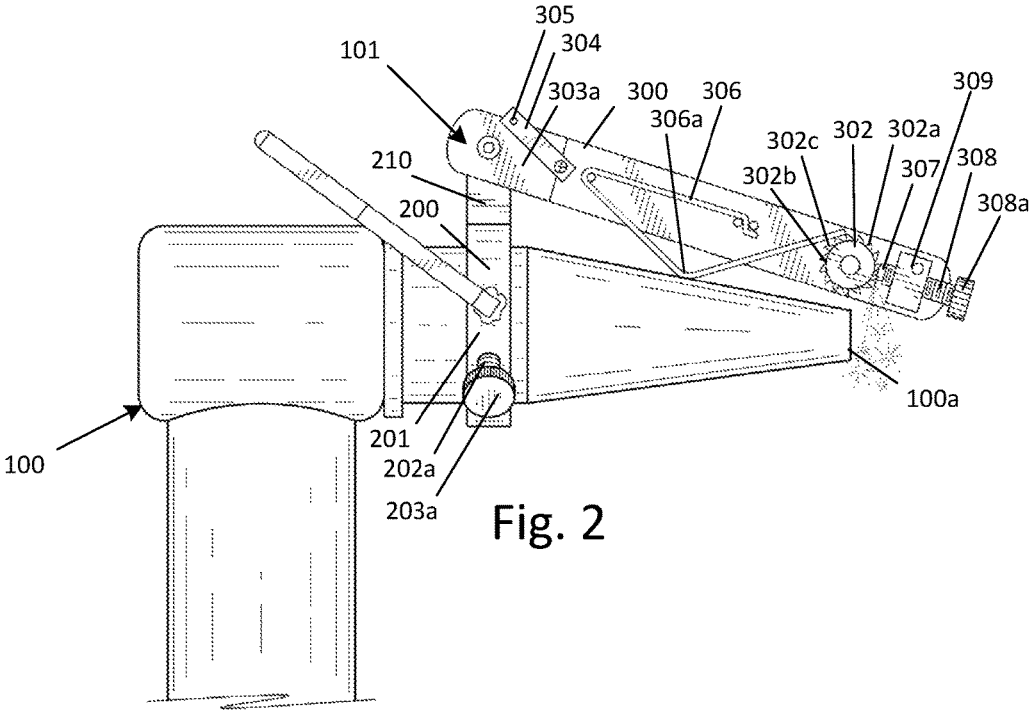
FIG. 2 is a side view of a gas-burning device with the invention affixed and moved forward in the deployed state. The guide member has been cut away.
Figure 3:
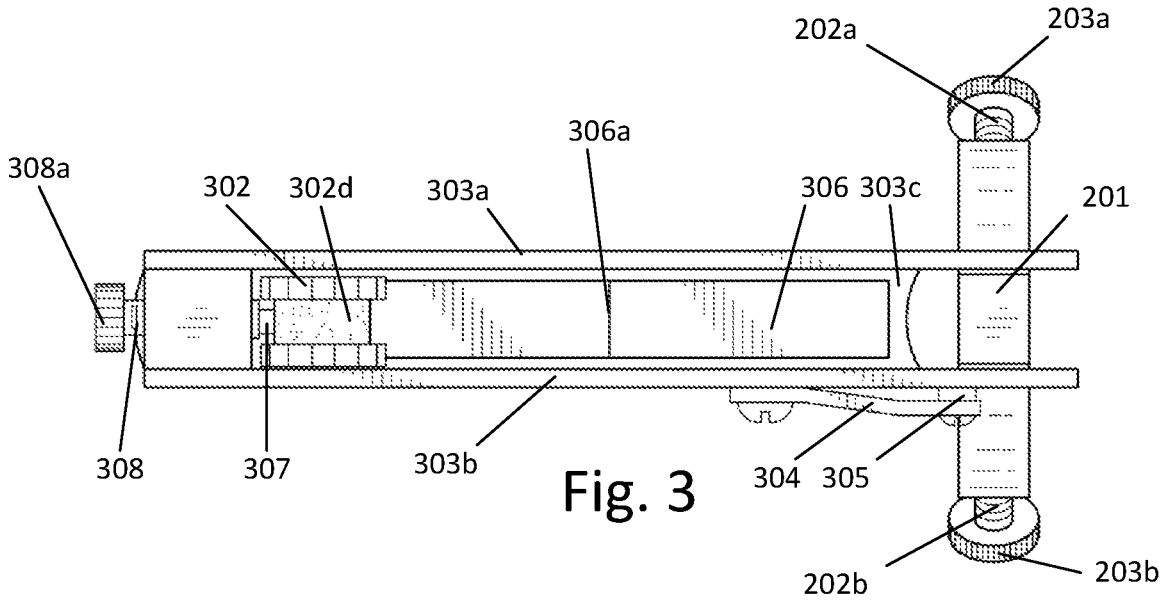
FIG. 3 is a top view of the invention.
Figure 4:
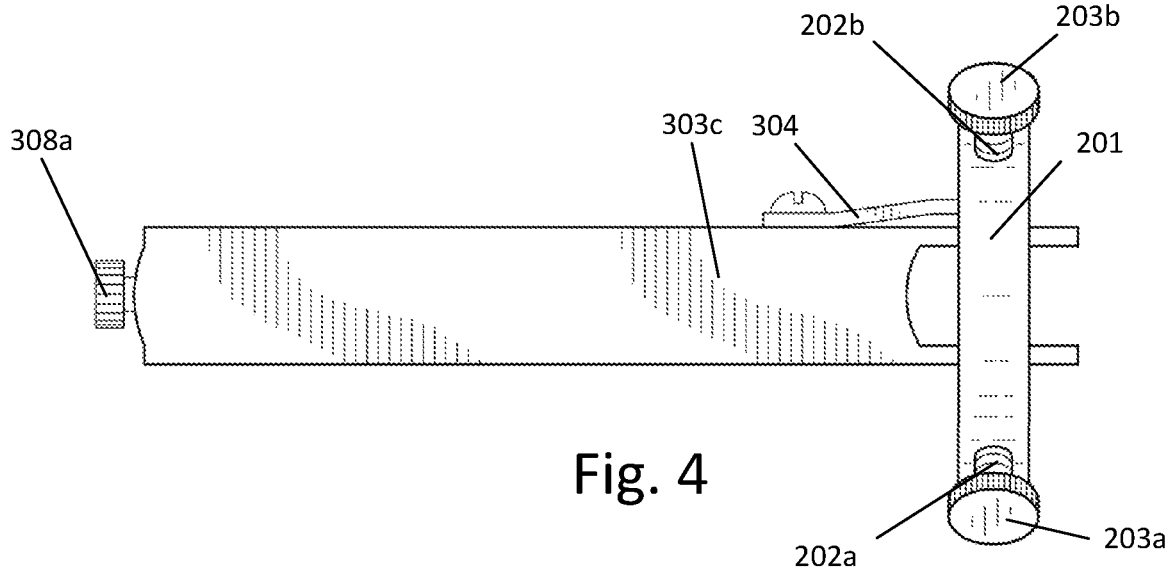
FIG. 4 is a side view of the invention.
Figure 5:
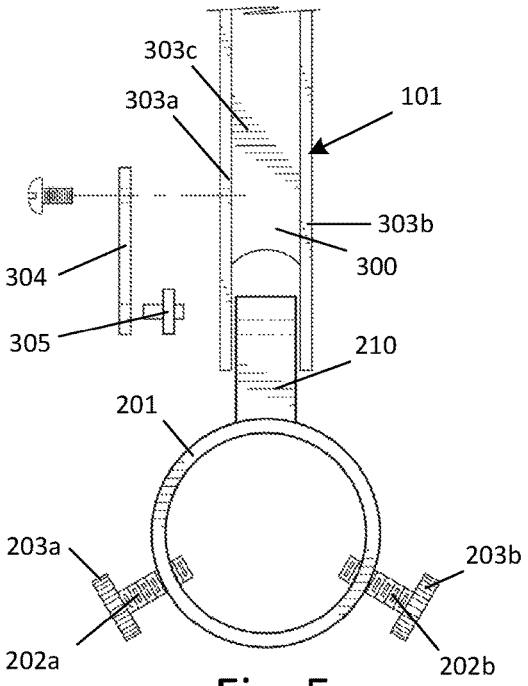
FIG. 5 is a front view of the invention with a detail showing the locking tab that engages with the radially cut locking slot in the affixing member.
Figure 6:
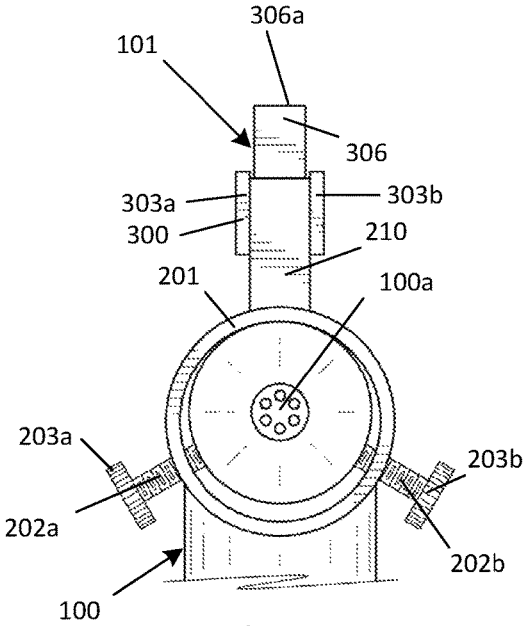
FIG. 6 is a front view of the invention affixed to a gas-burning tool with the guide member deployed away from the viewer.
Figure 7:
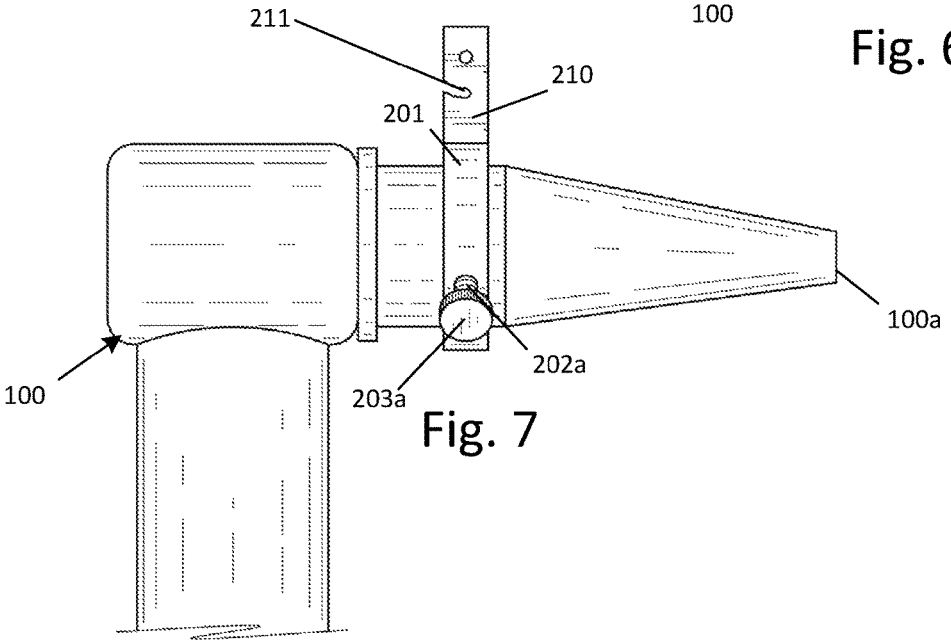
FIG. 7 is a side view the affixing member showing the radially projecting mounting tab with a locking slot cut into its rear tip.

Referring to FIG. 1-7, the preferred embodiment of the present invention is a spark generating device 101 comprising an affixing member 200 hingedly attached to a guide member 300 comprising a flint 307 comprising ferrocerium activated by a sparking wheel 302. The sparking wheel 302 is driven by a formed planar spring 306. The spark generating device 101 is affixed to the gas-burning tool 100 using the affixing member 200 to affix the device to the gas discharge end 100*a* of the gas-burning tool 100.

The affixing member 200 is a generally circular band 201 of a greater diameter that the gas discharge end 100*a* of the gas-burning tool 100 around which it is attached. Those having skill in the art will recognize that the affixing member 200 may be other geometries than circular and may be any shape necessary to affix the device to the gas discharge end 100*a* of the gas-burning tool 100.

The generally circular band 201 of the affixing member 200 has at least two radially penetrating screws 202*a* and 202*b* which have knurled screw tops 203*a* and 203*b* designed to be screwed in and out by hand. When screwed in, the radially penetrating screws 202*a* and 202*b* attach the affixing member 200 to the outside of the gas discharge end 100*a* of the gas-burning tool 100. Centrally located on top of the generally circular band 201 of the affixing member 200 is a radially projecting mounting tab 210 with a locking slot 211 cut into its rear tip.

Hingedly affixed to the affixing member 200 is the guide member 300. The guide member 300 is formed of two parallel, coequally sized pieces 303*a* and 303*b* hinged to the affixing member 200 and may be rotated in excess of 180° generally to the rear or generally to the front. Those having skill in the art will recognize that the guide member 300 may be formed in many ways, including being constructed of one piece of material bent or stamped to form two parallel, coequally sized pieces 303*a* and 303*b* and an attaching middle section 303*c* the entirety of which may be hinged to the affixing member 200 and may be rotated in excess of 180° generally to the rear or generally to the front. When rotated to the rear a locking strap 304 with a locking tab 305 engages with the radially cut locking slot 211 in the radially projecting mounting tab 210 to secure the guide member 300 to the rear. Ordinarily, this is the position of the guide member 300 when the gas-burning tool 100 is being used.

Secured between the parallel, coequally sized pieces 303*a* and 303*b* is a formed planar spring 306. The formed planar spring 306 is secured in a fixed position between the parallel, coequally sized pieces 303*a* and 303*b* such that its free end is positioned next to a sparking wheel 302 with generally triangular tangs 302*a* formed in its outer, circular surface 302*b*. The formed planar spring 306 is constructed such that a bent section 306*a* extends outside the confines of the parallel, coequally sized pieces 303*a* and 303*b*.

The sparking wheel 302 is comprised of three layers. Two outer layers have generally triangular tangs 302*a* contacting the formed planar spring 306. The side of each generally triangular tang 302*a* contacting the formed planar spring 306 projects radially from the circular surface 302*b* of the sparking wheel 302. The edge not contacted 302*c* by the formed planar spring 306 is non-radially arranged. The central layer has an abrasive layer of corundite or emery 302*d*. The abrasive layer of corundite or emery 302*d* may be adhesively applied or mechanically formed. The abrasive layer of corundite or emery 302*d* contacts the flint 307. Those having skill in the art will recognize that the flint 307 may be composed of ferrocerium. The flint 307 is mounted in the tip of an adjusting screw 308. The adjusting screw 308 has an externally exposed tanged head 308*a* designed to be screwed in and out to adjust the location of the flint 307 with respect to the abrasive layer of corundite or emery 302*d*.

The adjusting screw 308 is mounted at the end of the parallel, coequally sized pieces 303*a* and 303*b* in a mounting element 309 adjoining the free ends of the parallel, coequally sized pieces 303*a* and 303*b*. The adjusting screw 308 is configured such that as the adjusting screw 308 is screwed in, the flint 307 is brought nearer the abrasive layer of corundite or emery 302*d* on the sparking wheel 302.

The spark generating device 101 is used in the following manner: 1) The spark generating device 101 is affixed to the gas-burning tool 100 near the gas discharge end 100*a* of the gas-burning tool 100; 2) The radially penetrating screws 202*a* and 202*b* are adjusted using their knurled screw tops 203*a* and 203*b*, respectively, to clamp the spark generating device 101 onto the gas-burning tool 100; 3) The guide member 300 is rotated backwards so that the adjusting screw 308 faces away from the gas discharge end 100*a* of the gas-burning tool 100 and the locking tab 305 engages with the radially cut locking slot 211 in the affixing member 200; 4) The guide member 300 is rotated all the way forward until the bent section 306*a* in formed planar spring 306 contacts the barrel of the gas-burning tool 100 and is pressed down slightly; 5) This causes the sparking wheel 302 to rotate; 6) This causes the abrasive layer of corundite or emery 302*d* to rub against the flint 307; 7) This causes sparks to be showered near the gas discharge end 100*a* of the gas-burning tool 100; 8) This causes a flame to ignite; and, 9) After the flame has ignited, the guide member 300 is rotated backwards so that the adjusting screw 308 faces away from the gas discharge end 100*a* of the gas-burning tool 100 and the locking tab 305 engages with the radially cut locking slot 211 in the affixing member 200.

What is claimed is:

1. A striker for a gas burning tool comprising:

a. an affixing member for affixing the striker to the gas discharge end of a gas-burning tool with a radially projecting mounting tab;

b. a guide member comprising two parallel, coequally sized pieces wherein the guide member is hingedly attached to the radially projecting mounting tab and the two parallel, coequally sized pieces are attached at the other end by means of a mounting element;

c. wherein a flint is mounted to the tip of a screw and this screw passes through the mounting element wherein the flint contacts an abrasive layer on a sparking wheel mounted between the two parallel, coequally sized pieces;

d. wherein the sparking wheel is driven by a spring mounted between the two parallel, coequally sized pieces where the spring protrudes above the top of the two parallel, coequally sized pieces when the guide member is rotated so that the mounting element is away from the gas discharge end of a gas-burning tool;

e. wherein the spring drives the sparking wheel when the guide member is rotated towards the gas discharge end of the gas-burning tool and the part of the spring that protrudes above the top of the two parallel, coequally sized pieces when the guide member is rotated so that the mounting element is away from the gas discharge end of a gas-burning tool is pressed against the gas discharge end of the gas-burning tool.

2. A striker for a gas burning tool of claim 1 wherein the affixing member is circular.

3. A striker for a gas burning tool of claim 1 further comprising at least two radially penetrating screw elements penetrating the circular element.

4. A striker for a gas burning tool of claim 1 wherein the flint is ferrocerium.

5. A striker for a gas burning tool of claim 1 wherein the abrasive layer is corundite.

6. A striker for a gas burning tool of claim 1 wherein the abrasive layer is emery.

7. A striker for a gas burning tool of claim 1 wherein the screw may be adjusted so that the flint is in close contact with the abrasive layer on the sparking wheel.

8. A method of using a striker for a gas burning tool of claim 1 comprising the steps of:

a. affixing the striker near the gas discharge of a gas-burning tool;

b. rotating the guide member so that the screw is located away from the gas discharge of the gas-burning tool;

c. turning the gas on so that gas issues from the gas discharge of the gas-burning tool;

d. rotating the guide member so that the screw is located away towards the gas discharge of the gas-burning tool;

e. pressing the spring that protrudes above the top of the two parallel, coequally sized pieces when the guide member is rotated so that the mounting element is away from the gas discharge end of a gas-burning tool against the gas discharge end of the gas-burning tool;

f. driving the free end of the spring against the sparking wheel causing the sparking wheel to rotate;

g. causing the abrasive layer to rub against the flint;

h. showering sparks into the gas;

i. lighting the gas;

j. rotating the guide member so that the screw is located away from the gas discharge of the gas-burning tool.

* * * * *